US005884745A

United States Patent [19]

Kalis et al.

[11] Patent Number: 5,884,745

[45] Date of Patent: Mar. 23, 1999

[54] PIVOT KEYPAD AND DUAL INTERFACE FOR MULTIPLE PRICE AND SIZE SETTING VENDING MACHINE

[75] Inventors: Jeffery Kalis, Rockford; Thomas Meinardi, Grand Rapids, both of Mich.; Andris C. Sloss, Rockwall, Tex.; Lloyd Herring, Rockford, Mich.

[73] Assignee: Rowe International, Inc., Grand Rapids, Mich.

[21] Appl. No.: 792,835

[22] Filed: Jan. 30, 1997

Related U.S. Application Data

[63] Continuation-in-part of Ser. No. 643,153, Apr. 30, 1996, abandoned, which is a continuation-in-part of Ser. No. 71,713, Jun. 3, 1993, Pat. No. 5,511,646.

[51] Int. Cl.[6] ..... G07F 11/58

[52] U.S. Cl. ..... 194/217; 194/350; 364/479.08

[58] Field of Search ..... 194/217, 218, 194/350; 221/2, 5, 12, 76–79, 91, 242; 364/479.01, 479.08; 235/381; 312/91, 97

[56] References Cited

U.S. PATENT DOCUMENTS

| | | | |
|---|---|---|---|
| 1,592,069 | 7/1926 | Benson | 198/798 |
| 2,493,857 | 1/1950 | Cargill | 198/798 |
| 2,512,356 | 6/1950 | Massiello | 198/798 |
| 2,965,214 | 12/1960 | Schlumpf | 198/798 X |
| 3,202,265 | 8/1965 | Anders | 198/798 |
| 3,297,378 | 1/1967 | Krug | 312/597 X |
| 3,491,915 | 1/1970 | Gore et al. | 221/76 |
| 3,697,714 | 10/1972 | Weber | 312/91 |
| 3,902,950 | 9/1975 | Raynor | 198/798 |
| 4,231,105 | 10/1980 | Schuller et al. | 194/217 X |
| 4,326,620 | 4/1982 | Felix et al. | 194/350 X |
| 4,834,231 | 5/1989 | Awane et al. | 194/217 |
| 4,942,290 | 7/1990 | Frerking | 235/381 |
| 5,321,625 | 6/1994 | Humm et al. | 221/12 X |

OTHER PUBLICATIONS

Brochure of Rowe International, Inc. "Genesis™. The Look of the Future from Rowe."

*Primary Examiner*—F. J. Bartuska

*Attorney, Agent, or Firm*—Van Dyke, Gardner, Linn & Burkhart, LLP

[57] ABSTRACT

A programmable size and price setting mechanism for use in a vending machine has a plurality of η access doors aligned horizontally across a front of the vending machine, each of which access doors has a locked condition denying access therethrough and an unlocked condition allowing access therethrough, and each of which is selectably activatable between the locked and unlocked condition. There are a plurality of horizontal shelves each of which has a plurality of partitionable areas corresponding in size to a corresponding one of the η access doors, such that each shelf is selectably partitionable into a plurality of up to η product holding areas. A conveyor mechanism is provided for selectably moving each horizontal shelf into a vending position adjacent to the access doors so that each one of the η partitionable areas is adjacent to a corresponding one the η access doors. A sensor detects when one of the plurality of shelves is positioned adjacent to the plurality of η access doors. A keypad with a plurality of actuatable buttons is pivotably mounted on the vending machine for use by a consumer in a "vending mode" of operation and for use as a programming keypad to set compartment sizes and product prices when in a "service mode" of operation. A money receiving and value detection device is also provided. Programmable control circuitry is operatively interconnected with the keypad to the shelf position sensor and to the money receiving and value detection device for activating a selected one or more of the η access doors from the closed to the opened condition and positioning the selected one of the plurality of shelves and compartments into position adjacent to the access doors, upon detecting a programmed value of money received, and upon actuation of appropriate keypad buttons to select the desired compartment to actuate one or more of the η access doors through which access to one of the desired product holding areas is achieved.

15 Claims, 10 Drawing Sheets

FIG. 2
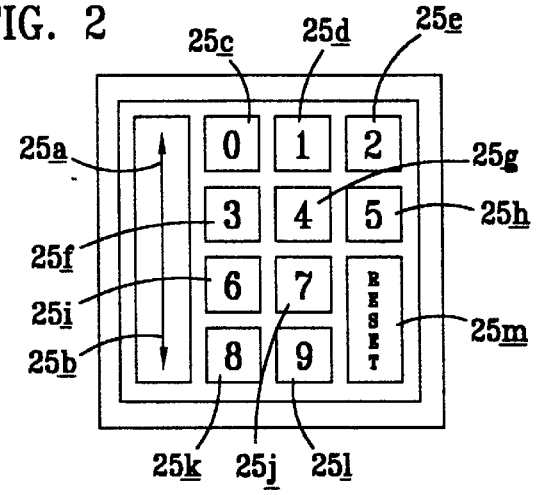
FIG. 3
KEY FUNCTIONS
RESET + 0 = LINE UP
RESET + 1 = LINE DOWN
RESET + 2 = MOVE RIGHT
RESET + 3 = MOVE LEFT
RESET + 4 = DELETE
RESET + 5 = INSERT
RESET + 6 = COPY
RESET + 7 = TOGGLE
RESET + ∧ = SHELF # UP
RESET + ∨ = SHELF # DOWN
FIG. 8
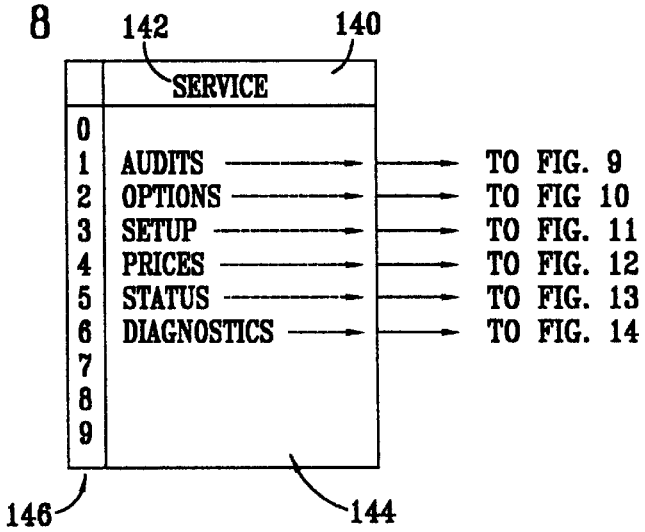

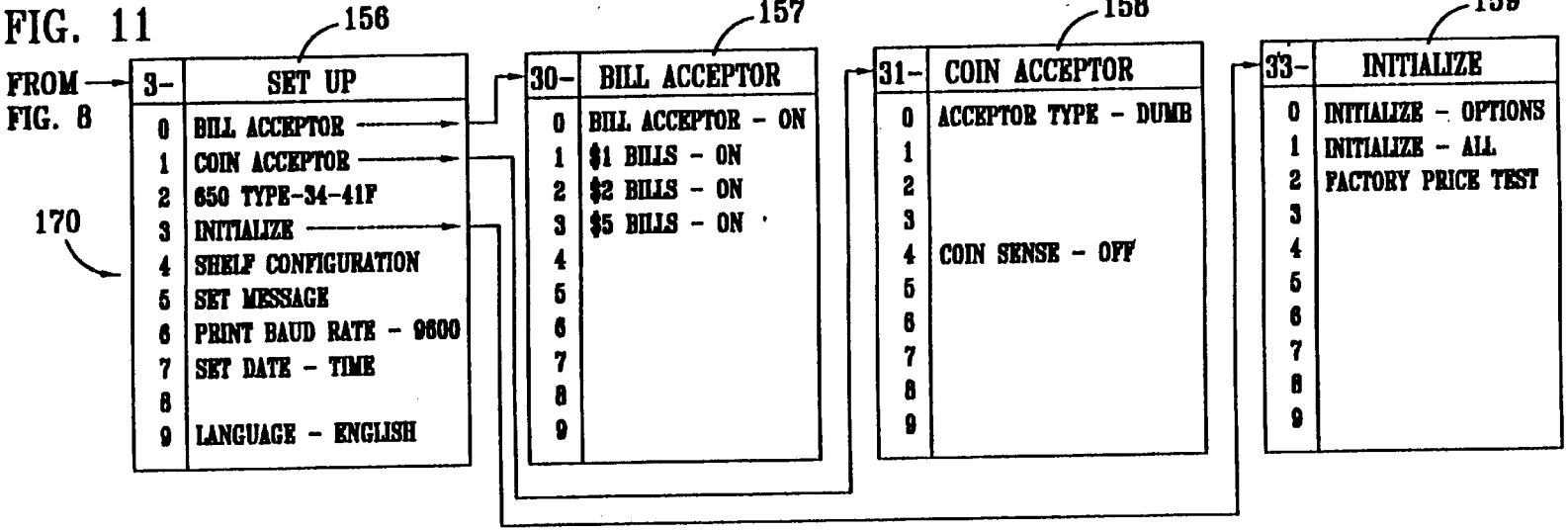
FIG. 11
FROM FIG. 8
156
3-
SET UP
0 BILL ACCEPTOR
1 COIN ACCEPTOR
2 650 TYPE-34-41F
3 INITIALIZE
4 SHELF CONFIGURATION
5 SET MESSAGE
6 PRINT BAUD RATE - 9600
7 SET DATE - TIME
8
9 LANGUAGE - ENGLISH
170
157
30-
BILL ACCEPTOR
0 BILL ACCEPTOR - ON
1 $1 BILLS - ON
2 $2 BILLS - ON
3 $5 BILLS - ON
158
31-
COIN ACCEPTOR
0 ACCEPTOR TYPE - DUMB
4 COIN SENSE - OFF
159
33-
INITIALIZE
0 INITIALIZE - OPTIONS
1 INITIALIZE - ALL
2 FACTORY PRICE TEST

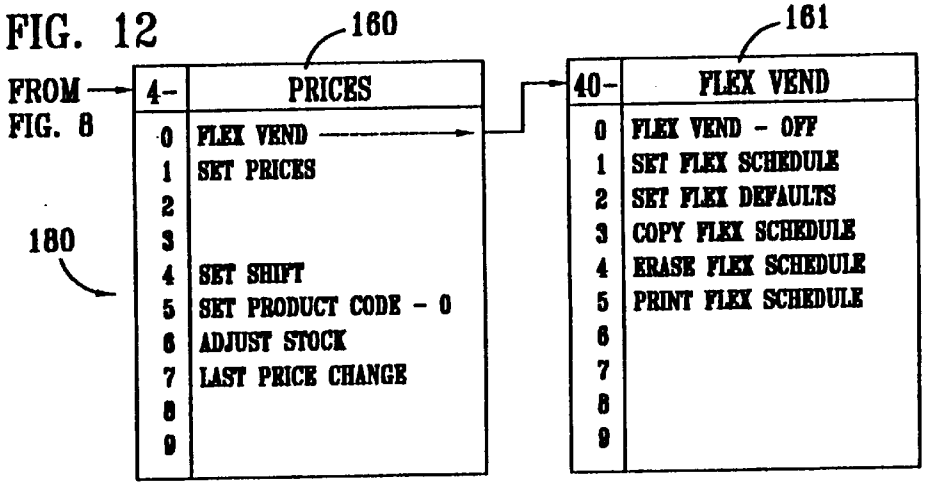
FIG. 12
FROM FIG. 8
160
4-
PRICES
0 FLEX VEND
1 SET PRICES
3 SET SHIFT
4 SET PRODUCT CODE - 0
5 ADJUST STOCK
7 LAST PRICE CHANGE
180
161
40-
FLEX VEND
0 FLEX VEND - OFF
1 SET FLEX SCHEDULE
2 SET FLEX DEFAULTS
3 COPY FLEX SCHEDULE
4 ERASE FLEX SCHEDULE
5 PRINT FLEX SCHEDULE

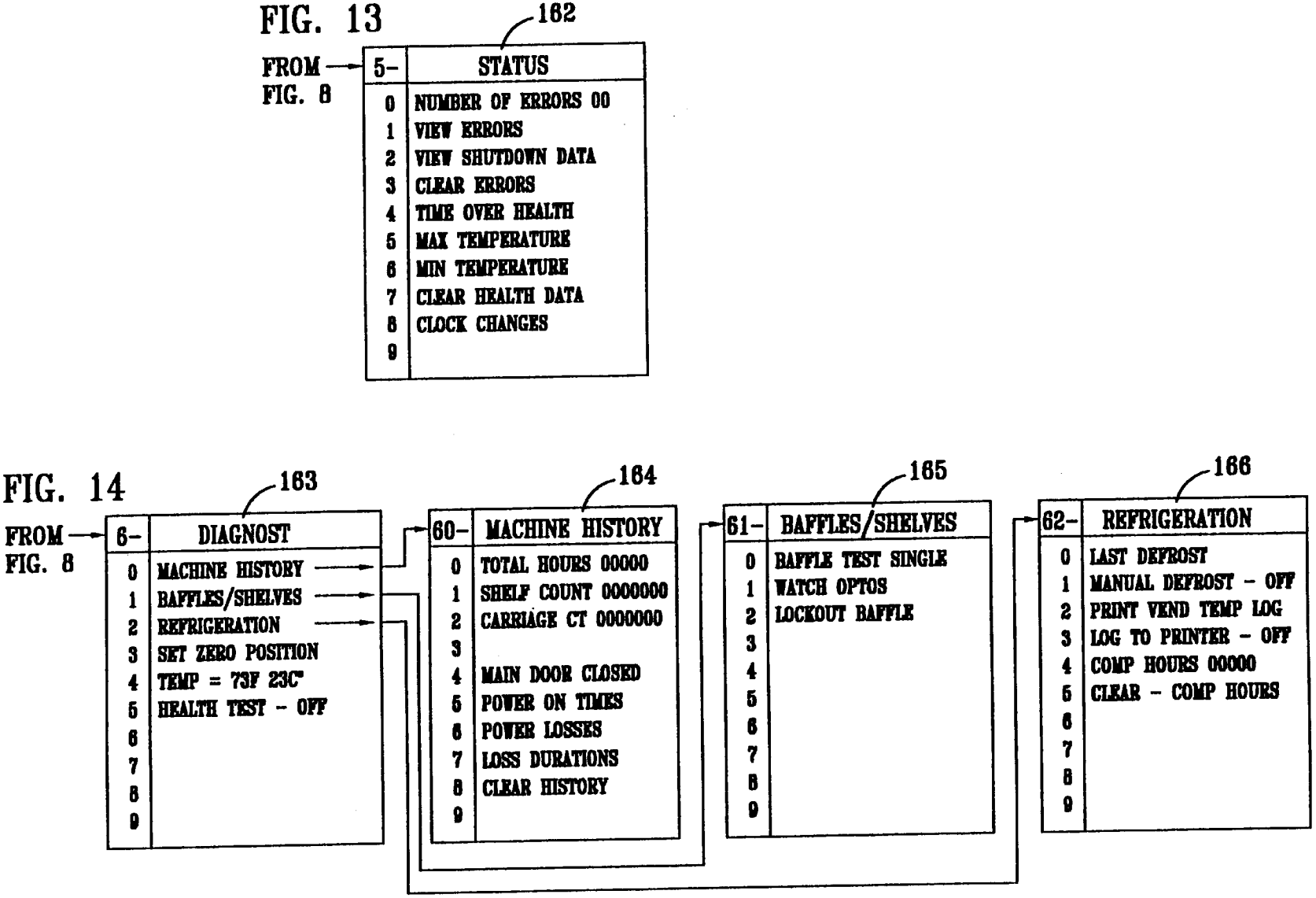
FIG. 13
FROM FIG. 8
162
5-
STATUS
0 NUMBER OF ERRORS 00
1 VIEW ERRORS
2 VIEW SHUTDOWN DATA
3 CLEAR ERRORS
4 TIME OVER HEALTH
5 MAX TEMPERATURE
6 MIN TEMPERATURE
7 CLEAR HEALTH DATA
8 CLOCK CHANGES
9
FIG. 14
FROM FIG. 8
163
6-
DIAGNOST
0 MACHINE HISTORY
1 BAFFLES/SHELVES
2 REFRIGERATION
3 SET ZERO POSITION
4 TEMP = 73F 23C
5 HEALTH TEST - OFF
6
7
8
9
164
60-
MACHINE HISTORY
0 TOTAL HOURS 00000
1 SHELF COUNT 0000000
2 CARRIAGE CT 0000000
3
4 MAIN DOOR CLOSED
5 POWER ON TIMES
6 POWER LOSSES
7 LOSS DURATIONS
8 CLEAR HISTORY
9
165
61-
BAFFLES/SHELVES
0 BAFFLE TEST SINGLE
1 WATCH OPTOS
2 LOCKOUT BAFFLE
3
4
5
6
7
8
9
166
62-
REFRIGERATION
0 LAST DEFROST
1 MANUAL DEFROST - OFF
2 PRINT VEND TEMP LOG
3 LOG TO PRINTER - OFF
4 COMP HOURS 00000
5 CLEAR - COMP HOURS
6
7
8
9

PIVOT KEYPAD AND DUAL INTERFACE FOR MULTIPLE PRICE AND SIZE SETTING VENDING MACHINE

CROSS-REFERENCE TO RELATED APPLICATIONS

This is a continuation-in-part application of U.S. patent application Ser. No. 08/643,153, filed Apr. 30, 1996, now abandoned, which was a continuation-in-art application of U.S. patent application Ser. No. 08/071,713, filed Jun. 3, 1993, which issued Apr. 30, 1996, as U.S. patent No. 5,511,646.

TECHNICAL FIELD OF THE INVENTION

The present invention relates to vending machines by which products of various sizes may be viewed, selected, and vended, upon insertion into the machine of an appropriate amount of money; and in particular, to a vending machine having a plurality of partitionable horizontal shelves on which products of various sizes may be placed, stored, and displayed for vending with a mechanism for movement of the shelves adjacent to a display area and for providing accessibility to a desired selection upon payment of an appropriate purchase price into the vending machine.

BACKGROUND OF THE INVENTION

Previously, vending machines of the type which held and displayed products on horizontal shelves have been constructed with a plurality of vertically stacked trays having a fixed number of partition areas on each tray for holding products to be vended. The horizontal shelves permitted display and vending of products having various shapes and sizes, such as fruit, sandwiches, prepared salads, prepared dinner plates, dairy products in containers, fruit drink cans, or other varieties of items which are not necessarily foodstuffs. At each vertical level, there was an openable door behind which a desired partitioned area could be positioned. Payment of a required fee and selection of a particular product by moving the partitioned area to the door permitted the door to be opened for removing the product.

One such device provided a plurality of rotatable circular trays with a display window and a single openable door at each level. The items could be selected by rotating the tray past the display window until a desired selection was adjacent to the openable door. Payment of the indicated purchase price allowed the door to be opened so that the selected item could be removed. Each separate tray would be partitioned into a plurality of product holding areas, each the same size as the others. Upon payment of the appropriate price for a product on a given tray, the vending door was openable only to the extent required to reach the product. In this manner, any given tray would be stocked with products of substantially equal size and equal value so that payment of the amount of money indicated for all of the items on a given tray would allow the door to be opened. A degree of variability was accomplished by providing a door with capabilities of pre-setting its opening size. A small opening was set corresponding to small partitioned areas, and a larger opening was set corresponding to larger partitioned areas. Trays at different levels could have different size partitioned areas, but all of the partitioned areas on a single tray had to be the same size. A given tray construction could be variably partitioned to accommodate different sizes, provided the entire tray was partitioned with the same size areas. A single preset opening size was needed for the entire tray at each level.

SUMMARY OF THE INVENTION

The present invention overcomes many of the drawbacks of the prior horizontal shelf vending machine by providing a plurality of vertically movable horizontal shelves carried on a continuous conveyor for maintaining the shelves in a horizontal orientation as they are moved on the conveyor. The conveyor moves the shelf past the display window on the front of the vending machine through which products carried on the shelves may be viewed. A plurality of doors are provided aligned horizontally across the front of the machine at one level, preferably at the bottom of the viewing window. Each door has a closed position denying access therethrough and an opened position allowing access therethrough, and each door is selectably activatable between the closed and the opened positions. The plurality of horizontal shelves are each selectably partitionable into a plurality of product holding areas. The number $\eta$ of doors corresponds to the maximum number of areas into which each shelf may be partitioned. Each partitionable area corresponds in size to the size of one of the $\eta$ access doors. The shelves are alternatively partitionable into larger product holding areas corresponding in size to two or more of the smaller product holding areas combined. Preferably, each of the $\eta$ access doors and each of the $\eta$ individual units of the partitionable product holding areas is the same size. A keypad having a set of actuatable buttons is mounted on the vending machine, preferably adjacent to the display window for easy access by the purchaser. The keypad is interconnected with programmable control circuitry such as a central processing unit (CPU) for actuating one or more of the doors from a closed to an opened position upon payment of an appropriate purchase price and upon pressing an appropriate corresponding address code using buttons on the keypad and payment of the product purchase price. The programmable control circuitry is operatively connected not only to the keypad but also to shelf position detection means and to the money receiving and value detection means for activating a selected one or more of the $\eta$ access doors from the closed to the opened position after moving the horizontal shelf which corresponds to the product holding area address to the product delivery position according to the button(s) actuated on the keypad and upon comparing the programmed and stored price for the selected shelf and button input address to a detected value of money received. If the comparison indicates that the amount of money deposited by the purchaser and received into the vending machine is greater than or equal to the programmed price, a signal is produced which is operable to move the selected shelf to the product delivery position and an additional signal is produced which is operable to move a selected one or more of the $\eta$ doors from the closed to the opened position for access to the product holding area therethrough.

According to another feature of the invention, an electronically controlled visual display is attached to the vending machine for displaying the selected product holding area address code. The programmable control circuitry is provided with an operation mode and with a programming mode. Means for selecting between the modes may include a key by which a service door on the vending machine is opened for service by an owner or concessionaire of the vending machine. The program keypad is connected to the programmable control circuitry, to a visual display, and to a shelf position detector such that, in the program mode, actuation of buttons on the keypad will permit the operator to set a size of a product holding area, in terms of a selected number of the individual unit sizes into which a shelf may be partitioned. Each partitioned product holding area will be automatically designated with an address code corresponding to a particular horizontal shelf and to a position along the particular shelf at which the product holding area is located. The operator can also program a product price for each address-coded product holding area, which price will be stored in "memory", such as in a data storage registry of the control circuitry corresponding to an address code of a partitioned area for which the price is to be set. Upon setting prices for each of the shelf product areas, the machine can be actuated into its operation mode, as by closing and locking the service door, and the set prices are stored in a memory.

With the service door closed and locked, purchasers can press a button on the keypad to activate the shelf conveyor and to move a desired product into view through the display window. The product holding areas on the horizontal shelves are preferably labeled with an address code and a price which is also visible through the display window. After observing the desired product, the address code of the desired product can be entered by the purchaser through the keypad and the selection and price is confirmed by being displayed on a display panel, such as an electronic display panel. Upon deposit of the indicated purchase price into money deposit slots, the amount of money detected is displayed on the display panel, and if the amount matches or exceeds the price for the selection, and if the product holding address is not in a position adjacent the vending access doors, the control circuitry automatically activates the shelf conveyor, moving the selected product holding area into position adjacent the vending access doors, then automatically actuates a door opening mechanism for one access door or for a number of access doors corresponding to the position of the product holding area which was selected by entering its address code on the keypad. The purchaser can then lift the outer door and remove the purchased product from the product holding area. The access door or doors will be actuated to a closed position by the control circuitry, when a button is pressed on the keypad to activate the shelf conveyor and the outer door is closed or after a time delay after the outer door is closed, such as two minutes.

Uniquely and advantageously, the keypad has functions for purchasing and for programming. The purchaser selects and actuates buttons for moving the shelves and for entering an address code corresponding to the address of a desired product holding area. Also, the keypad serves as a keypad for programming of the control circuit by the owner, operator or concessionaire of the vending machine. Preferably, the keypad is provided with a display in close proximity and both are mounted so that the buttons of the keypad project through a service door and also the display panel is observable through the service door. Preferably, holes are formed in the service door so that the keypad and display panel are mounted to the rear surface of the service door parallel to the front surface of the service door. When the service door is closed the keypad acts as a purchaser selection control mechanism, and when the access door is pivoted into an opened position for service of the vending machine the keypad acts as a programmable operator panel.

For additional convenience, the keypad preferably and uniquely pivots about a mounting hinge so that it is conveniently accessible from the front of the vending machine, even when the service door is pivoted closed. When the service door is pivoted open, the keypad is pivoted away from the service door so that its front surface is no longer parallel to the front of the vending machine. Programmable features include menus from which various programmable service features may be selected and, in particular, the menus include a setup menu by which the size and address location of product holding areas can be programmed and set, and also a program mode in which the prices may be separately set for any of the product holding areas designated in the setup mode. In each service mode of operation, a particular feature can be accessed by sequentially indexing through the menu features until the desired feature and subfeature is indicated or, alternatively, each feature, including sub-aspects of the feature, can be addressed directly using a numeric multitiered menu location. One additional advantageous feature of the keypad is the inclusion of a "reset" button which acts or functions much as a shift key on a typewriter to provide each button on the keypad with a second function. For example, the numeric buttons or keys can have a meaning or a function such as "toggle", "copy", "enter" or "delete", which functions are beyond merely indicating the particular numeric digit of the keypad button.

In combination with the service door which pivots about a vertical hinge, a control panel circuit board is provided with slide access capabilities. The slidable circuit board is located parallel the side of the vending machine cabinet behind the service door, thereby minimizing size and frontal clearance required to access and/or service the circuit board. With a relatively narrow service door in an open position, the circuit board can be slid out in front of the vending machine for service, repair or modification by the operator.

An additional advantageous feature of the vending machine is the use of independent or separately actuatable rotational motors to open the η access doors. Each motor is provided with a threaded rotary shaft which rotary shaft is engaged with a connector nut fastened to one of the access doors. Upon actuating the reversible motor in a first direction, the shaft rotates to open the access door. The door is fully opened by either rotating the motor a predetermined number of revolutions or by activating power to the motor until a shutoff switch is contacted by the door. To return the door to a fully closed position, the motor is activated in a reverse rotation direction for either the same number of rotations or until another switch is contacted by the door. Preferably, each separate access door moves along vertical slide tracks between opened and closed positions. The access door access mechanism is automatically deactivated when the purchaser opens an outer door for access to the product holding area. When the outer door is returned to its closed position, then the motor access actuator is again placed in an activatable position and may return to its closed position.

Yet another advantageous feature of the vending machine is the use of a separately actuatable rotational motor to move the plurality of vertically movable horizontal shelves. The motor is provided with an encoder which is attached to the motor output shaft. The motor output shaft additionally has a coupler which engages the drive shaft of the plurality of vertically movable horizontal shelves. Upon actuating the reversible motor in the first direction, the output shaft rotates in one direction, moving the plurality of vertically movable horizontal shelves past the position adjacent the vending access doors. Each horizontal shelf will be properly aligned with the vending access doors after a predetermined rotation of the output shaft, such as one-third of a rotation. The attached encoder is opaque with a predetermined number of open slots or windows to allow a light beam from a slotted optical switch to pass through the encoder. The slotted optical switch is interconnected to the CPU for detection of the blocking or passing of the light beam corresponding to alignment of a horizontal shelf to the vending access doors. One of the plurality of vertically movable horizontal shelves has a switch activating device attached to it, such as a magnet for activating a magnetic reed switch which is interconnected to the CPU indicating when this particular shelf is aligned with the vending access doors. The position of each horizontal shelf will be known to the CPU by the activation of the magnetic reed switch and each subsequent signal from the slotted optical switch as the plurality of vertically movable horizontal shelves is moved by activation of the rotational motor.

BRIEF DESCRIPTION OF THE DRAWINGS

These and other objects, advantages and features will be more fully understood with reference to the following specifications, claims and drawings in which like numerals represent like elements and in which:

FIG. 2 depicts a keypad with actuatable keys or buttons for both programming the vending machine control circuit and also for operating the vending machine for purchasing vendable items;

FIG. 3 is a table of key functions achievable by combining actuation of a "reset button" with actuation of another one of the digit buttons or arrow buttons on the keypad of FIG. 2;

FIG. 8 is a schematic depiction of a service mode menu map by which the programmable features of the control circuit may be accessed;

FIG. 11 is a schematic depiction of another selected portion of the service mode menu map of FIG. 8 for setup features, including various submenus for subfeatures;

FIG. 12 is a schematic depiction of another selected portion of the service mode menu map of FIG. 8 for product prices, including submenu features;

FIG. 13 is a schematic depiction of another selected portion of the service mode menu map of FIG. 8 for status features, including a submenu of status features; and FIG. 14 is a schematic depiction of another selected portion of the service mode menu map of FIG. 8 for diagnostic features, including submenus for various subdiagnostic features.

DETAILED DESCRIPTION OF THE PREFERRED EMBODIMENTS

Figure 1:
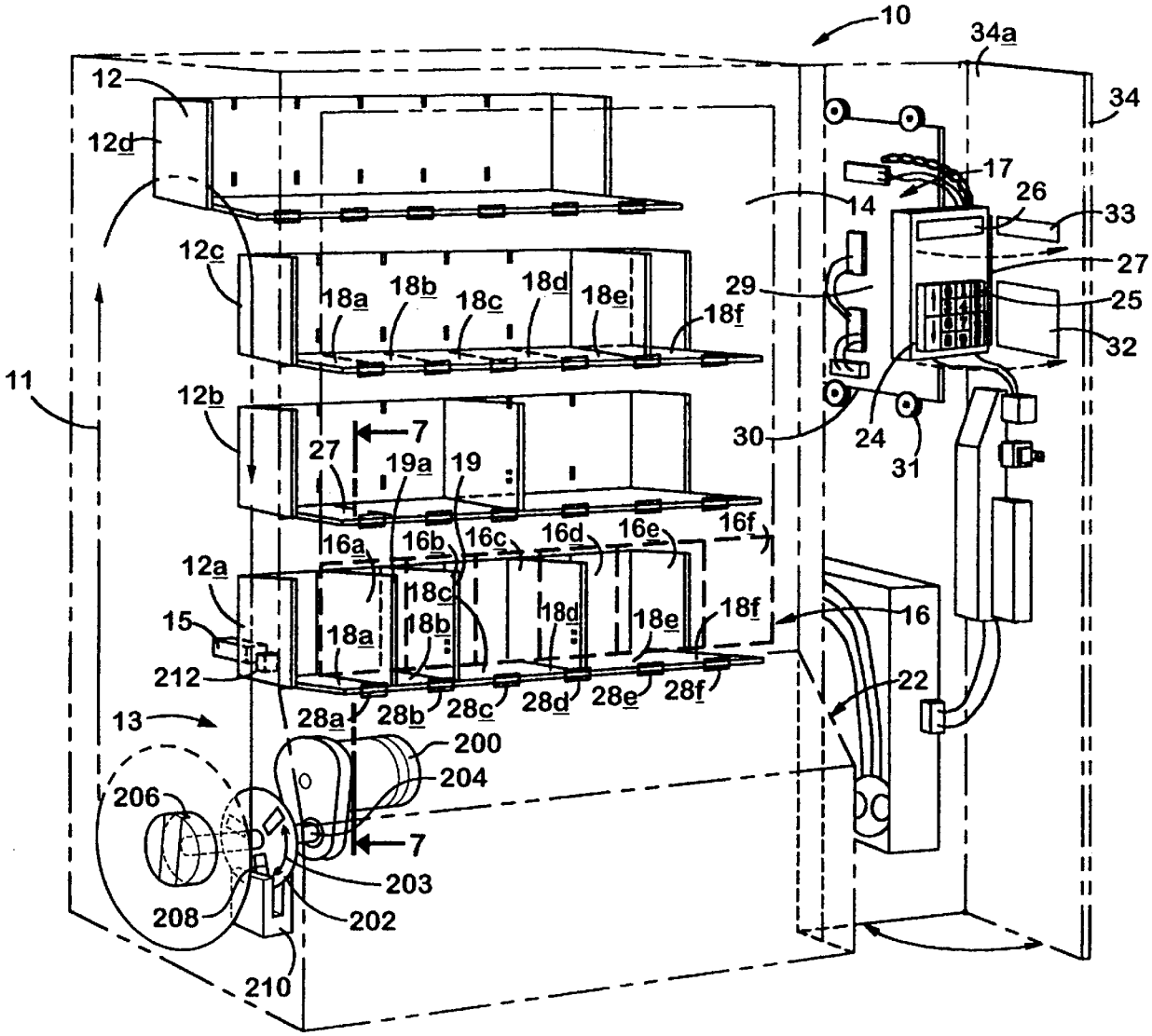
FIG. 1 is a schematic front perspective view of a vending machine with a programmable price setting mechanism according to the present invention.

FIG. 1 depicts a front perspective view of a vending machine 10 which includes a plurality of horizontal shelves 12 which are movable vertically within the vending machine 10 as with a vertical conveyor 11 which is schematically depicted with phantom lines in FIG. 1. Although a number of individual shelves 12*a*, 12*b*, 12*c* and 12*d* are depicted, it will be understood that preferably additional shelves (not shown) will be positioned on conveyor 11. The conveyor 11 may advantageously be constructed according to a co-owned U.S. Pat. No. 5,407,263, entitled "Drive Mechanism for Moving a Horizontal Shelf in a Vending Machine," which application is incorporated by reference as if fully set forth herein. Conveyor 11, such as a motorized vertically moving shelf mechanism 11, maintains shelves 12 in a horizontal orientation with a portion of the plurality of shelves 12 being moved into viewable position at front window 14. A horizontal portion of the front window 14 forms an access panel of doors 16, including a plurality of access doors 16*a*–16*f*. A shelf position detector mechanism 13, which is schematically depicted at 13 in FIG. 1, preferably includes a sensor switch 15 actuatable to signal the central processing unit 17 each time a particular shelf passed the sensor switch. Preferably, a "home base" shelf 12*a* activates the sensor switch 15 when "home base" shelf 12*a* passes the access panel of doors 16. A central processing unit 17 stores this information. A motor 200 and motor control feedback to the central processing unit 17 provides shelf movement information by which the central processing unit can determine which shelf is adjacent to the access windows.

The motor 200 is reversible and is provided with an encoder 202 which is attached to the motor output shaft 204. The motor output shaft 204 additionally has a coupler 206 which engages the drive shaft of the plurality of vertically movable horizontal shelves. Upon actuating the reversible motor 200 in the first direction, the output shaft rotates in one direction, moving the plurality of vertically movable horizontal shelves 12 past the position adjacent the vending access doors 16. Each horizontal shelf 12 will be properly aligned with the vending access doors 16 after a predetermined rotation 203 of the output shaft 204, such as one-third of a rotation. The attached encoder is opaque with a predetermined number of open slots 208 or windows to allow a light beam from a slotted optical switch 210 to pass through the encoder 202. The slotted optical switch 210 is interconnected to the CPU 17 for detection of the blocking or passing of the light beam corresponding to alignment of a horizontal shelf to the vending access doors. One of the plurality of vertically movable horizontal shelves has a switch activating device 212 attached to it, such as a magnet 212 for activating the sensor switch 15, such as a magnetic reed switch 15, which is interconnected to the CPU 17 indicating when this particular shelf 12a is aligned with the vending access doors 16. The position of each horizontal shelf will be known to the CPU by the activation of the magnetic reed switch and each subsequent signal from the slotted optical switch 210 as the plurality of vertically movable horizontal shelves is moved by activation of the rotational motor 200.

This effectively senses the position of each of the shelves at all times. Preferably, the shelves are moved in a step-wise fashion, such that the operator, whether the consumer or the concessionaire, may move each next shelf 12 into alignment with the access panel with a single toggle button.

The access panel is provided with a plurality of $\eta$ access doors, wherein $\eta$ is an integer number corresponding to the total number of access doors. For purposes of clarity in this application, a convention of terminology will be adopted. The leftmost door, when viewed from the front of the vending machine, is designated as the first door 16*a*. The next door 16*b* to the immediate right of the first door 16*a* is designated as the second door. The next door 16*c* to the right of the second door is designated as the third door, 16*d* as the fourth door, 16*e* as the fifth door and 16*f* as the sixth door. The total number of doors may be more or less than shown.

Horizontal shelves 12 are positionable in vertical alignment with the access doors 16. Each shelf 12 is partitionable into η product holding areas 18 with the first area 18*a* corresponding in location and corresponding in size to first door 16*a*, second partitionable area 18*b* corresponding in location and size to door 16*b*, and with third partitionable area 18c similarly corresponding to door 16*c*, fourth partitionable area 18*d* similarly corresponding to fourth door 16*d*, fifth partitionable area 18*e* similarly corresponding to fifth door 16*e*, and the ηth area 18*f* corresponding to the ηth door 16*f*. Each partitionable area is selectably partitionable from its next adjacent area with rigidly affixable partitions 19 as depicted for shelf 12*a*, wherein partition 19*a* separates areas 18*a* and 18*b*. The partitionable areas may also be combined with a next adjacent partitionable area to form a larger product holding area by removing or simply not attaching a partition 19 between two or more adjacent partitionable areas. For example, on shelf 12*a*, areas 18*c* and 18*d* are combined and areas 18*e* and 18*f* are combined into larger product holding areas 21 and 23, respectively. There are a wide variety of possible combinations of product holding areas 18*a*–18*f* into larger combined areas. Some of the possibilities are schematically indicated in FIG. 1 at shelves 12*b*, 12*c* and 12*d*.

In operation, a larger product holding area is created by removing one or more partitions 19 from between one or more adjacent partitionable areas 18. Access into such a larger product holding area is provided by opening one or more correspondingly adjacent doors 16. Thus, if the third area 18*c* and fourth area 18*d* are combined, the resulting product holding area 21 is accessed by opening both the third door 16*c* and fourth door 16*d*.

In the preferred embodiment, each door 16 and each partitionable area 18 are conveniently formed of the same size as each other door and each other partitionable area so that economies of scale can be obtained in the manufacture of vending machines for a variety of applications. The selectable partitionability of each of the moveable horizontal shelves 12 provides substantially unlimited versatility without requiring separately sized access doors 16 and separately sized shelf areas 18.

However, many of the aspects and advantages of the present invention may be obtained even where each access door is separately sized, provided the correspondingly located product holding areas on each of the horizontal shelves are also correspondingly sized (not shown). To permit access into the differently sized doors and product holding areas, all shelves would have similarly sized product holding areas and access to the product holding areas would be through opening of corresponding access doors. Combined holding areas could still be accessed through a corresponding combination of access doors.

When the vending machine 10 is closed, that is when the service door 34 is closed and locked, the vending machine is in a condition for product vending. FIG. 2 depicts a keypad 25 with actuatable keys 25*a*–25*m*. The same keypad 25 is used both for programming the vending machine control circuit and also for operating the vending machine for purchasing selected vendable items. Keypad 24 and a display panel are exposed and viewable at the exterior front of the vending machine cabinet. The buttons 25 on keypad 24 are actuatable for controlling movement of the shelves and also for selection of products for vending from the partitionable areas 18*a*–18*f*. Through the use of the consumer control keypad 24, shelves 12 may be moved past window 14 sequentially into view through display window 14 until a desired product is observed by the consumer. The price of the item or desired product in each of the areas 18*a*–18*f* will be displayed to the consumer. For example, the price may be displayed at main display 26 upon depressing one or more numeric keys 25*c*–25*l* corresponding to a particular product holding area. The price may also be displayed at individual price changeable displays 28*a*–*f* which are affixed to the front of the horizontal shelves in alignment with the partitionable areas 18*a*–18*f*.

Upon depositing or inserting an amount of money, the money receiving and amount detector will signal whether the amount is equal to or greater than the price of an item which corresponds to the actuation of a numeric selection button 25*c*–25*l*. A selection is made by pressing a three-digit combination that corresponds to the desired product. Once a selection choice has been made with the keypad, the conveyor will automatically move the selected shelf into the vend position. The inner baffle door will open and the customer can open the outer delivery door to remove their purchase. A vend can be canceled at any time prior to the opening of the inner baffle door by pressing the reset button. As a safety precaution, the inner delivery door will not close if the outer delivery door is open. When the product holding area is aligned with the dispensing area access doors and the price of the selection matches the amount deposited, the access door or doors adjacent to the selected product area will be actuated to an opened position. Thus, in the embodiment shown, with shelf 12*a* positioned adjacent to doors 16 so that it is in a vending position, payment of the amount of money indicated at display 28*a* or indicated in electronic display panel 26 and depressing or pushing the appropriate keypad button 25*c*–25*l* will open door 16a for access into item holding area 18*a*.

If, for example, a desired item is in a combined product holding area 21 formed from partitionable areas 18*c* and 18*d*, the customer can obtain the product. First, the price is visible at 28*c* and when the appropriate keypad selection button (or buttons) are pushed corresponding to the address of area 18*e*, the price will preferably appear at panel 26. Second, deposit of the indicated amount will be detected and valued by the CPU and will automatically actuate both doors 16*c* and is 16*d* from their closed position to their opened position, after the appropriate keypad selection buttons are pushed corresponding to the address of area 18*e*. The price of the item in combined area 18*c* and 18*d* may also be indicated at price display 28*d*. Preferably, in order to avoid confusion, 28*d* will be provided with a blank price label or a price label indicating that the price information should be obtained elsewhere (as at label 28*c*). By way of example but not limitation, dashed lines, zeros or like characters may be displayed in area 28*d*.

Also, schematically depicted in FIG. 1 is pivotable keypad 24 which functions as a programming keypad, rather than as a customer dispensing keypad, only when the vending machine 10 is placed in a "service mode" such as by unlocking a service door 34. Preferably, the service door 34 is pivotable about a vertical axis 34*a* at a front corner of the vending machine cabinet. In the open pivot position, the vending machine 10 can be most conveniently programmed using the same numeric keypad 24 as was used by purchasers for product selection. With reference also to FIG. 3, which is a schematic depiction of additional key functions achievable by combining actuation of the "reset" button 25*m* with one of the digit keys 25*c*–25*l*, one can better understand the programming which will be described more fully below with reference to the flow charts of FIGS. 4 and 5. The program input keypad 24 is desirably pivotable away from the service door 34 for convenient access by a concessionaire from in front of the vending machine while the concessionaire is filling the product holding areas 18. Preferably, in this position, the consumer control keypad 24 will automatically be placed in the programming mode and will be easily accessible. Also, the main display 26 will be easily viewable because it pivots with the keypad. This is made possible by openings 32 and 33 in the service door 34 through which display 26 and keypad 24 are accessible with the service door closed.

Also, depicted in FIG. 1 is a panel 29 on which CPU 17 or the control circuitry is mounted for interconnection with the vending machine motors, keypad, conveyor, money receiving and counting and refrigeration units of the vending machine. Uniquely, the panel 29 slides out on tracks 30 and parallel rollers 31. Thus, when service door 34 is pivoted opened, the panel 29 can slide out parallel to the side of the vending machine for access, service and/or repair.

With the product viewing window 14 also pivoted open, the concessionaire can selectably arrange partitions 20 to obtain desired partitioned product holding areas 18 or combinations thereof. The sizes selected can be programmed (as in FIG. 4 below). Preferably, the concessionaire can fill the partitioned areas 18 with appropriately vendable products directly onto the shelves 12. For this purpose, opening window 14 will open the front of shelves 12. Window 14 is openable with the vending machine in its service mode. In the service mode, the shelf moving controls of the keypad work as they do for a purchaser to move the shelves vertically from one vending position to the next. The price of the item in each of the partitioned areas 18*a*–18*f* can be maintained as previously set or the price can be reprogrammed as desired by the concessionaire (as in FIG. 5 below).

Figure 4:
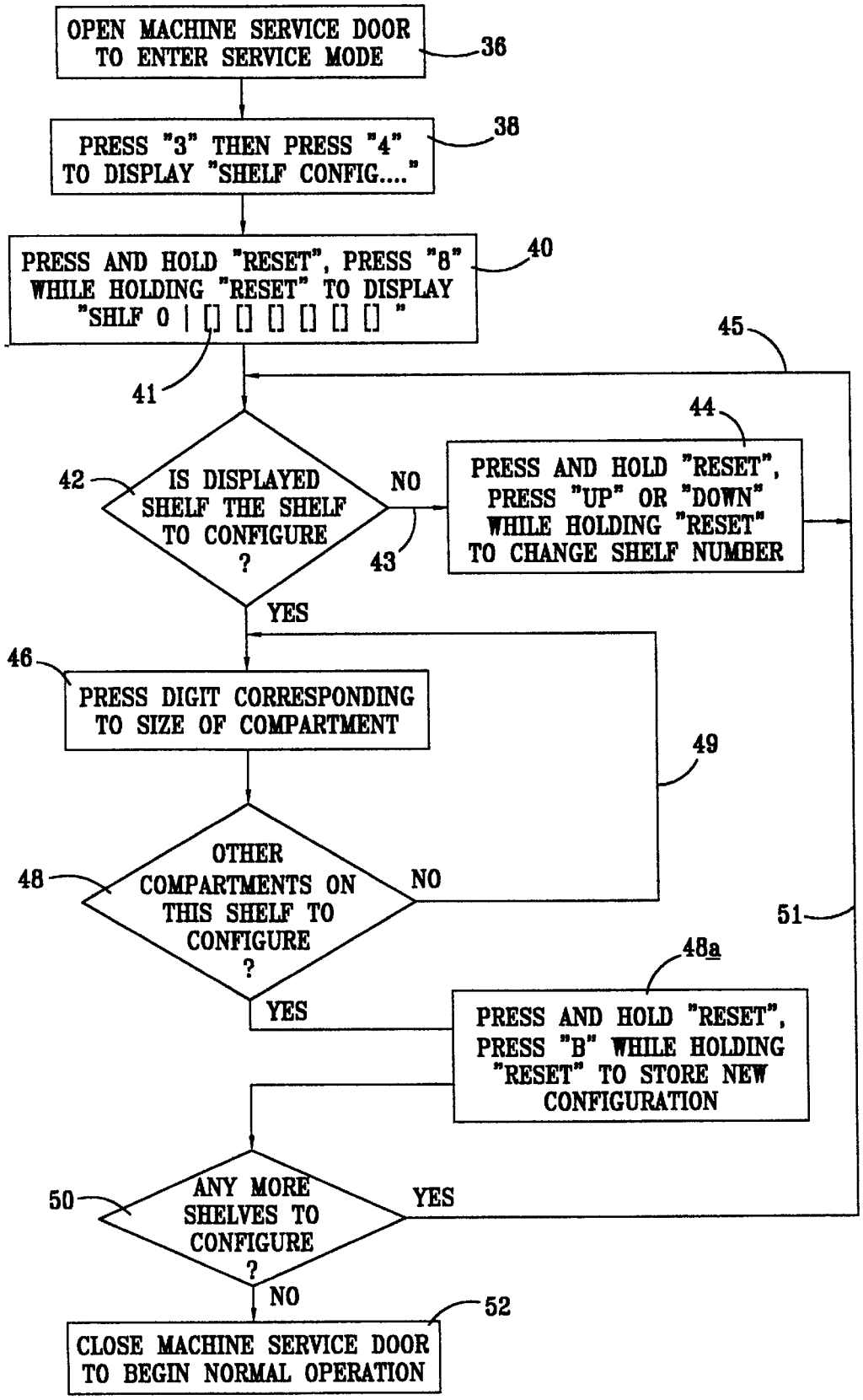
FIG. 4 is a schematic block diagram of programmable control circuitry and method of size setting according to the present invention.

FIG. 4 depicts a schematic logic block diagram or flow chart for the size programming circuitry and its method of use for selectably programming the appropriate size of the product holding areas or compartments as they have been selected through partitioning the shelves. First, the vending machine is placed in a service mode as by opening service door 34 as indicated at block 36.

Once the machine is in the service mode, the service menu will be available for selection of various menus or submenus as set forth more fully below with respect to FIG. 8. For purposes of shelf configuration, pressing the appropriate digits designating the shelf configuration mode, and in this embodiment pressing digit number "3" and then number "4", will display shelf configuration as in logic block 38. Once in the shelf configuration mode, pressing the "reset" button and holding it while also pressing the number "8", as in logic block 40, will cause the current shelf configuration display 41 to appear. Both the shelf number, counting from the home shelf, will also be displayed, and also brackets indicating the current configuration of the shelf holding areas or the compartments for the indicated shelf number. The operator will then be prompted, as in question block 42, whether the displayed shelf is the one to be configured. If not, logic path 43 leads the user to logic block 44 where holding the "reset" button and pushing either "up arrow" or "down arrow" will cause the shelf number to change. As set forth in FIG. 3, the additional key function of "reset" plus "up" is for shelf number up and "reset" plus "down" is for shelf number down, thereby toggling the shelf number. After toggling the shelf number, logic path 45 leads the user back to the question to confirm that the displayed shelf is the shelf to configure. If so, then the user is moved to logic block 46 and is prompted to press a digit corresponding to the size of the first compartment. The digit "1" would make the first compartment a unitary compartment size, pressing "2" would make the first compartment the size of two unitary partitionable areas, etc. After having chosen the first compartment size, logic question 48 prompts the user to indicate whether all the compartments on the indicated shelf are configured. If not, logic path 49 returns the user to block 46 by which the next compartment size will be selected using digits, as before. Returning again to logic question 48, if all compartments on that shelf are configured, the user is moved to block 48*a* where holding the "reset" button and pushing the "8" button will store the new shelf configuration in memory. The user is then moved to question block 50 and asked whether any other shelves are to be configured. If so, logic path 51 returns the user to the confirmation question 42: Is the shelf to be configured? If not, the shelf can be changed as in block 44, and once the desired shelf is displayed then setting of the compartment size at block 46 is initiated until all the compartments on that shelf are configured and then until all the shelves for which configuration is desired are configured. When there are no more shelves to be configured, the operator is moved to logic block 52 to close the service door to return the vending machine to normal vending operation.

Figure 5A:
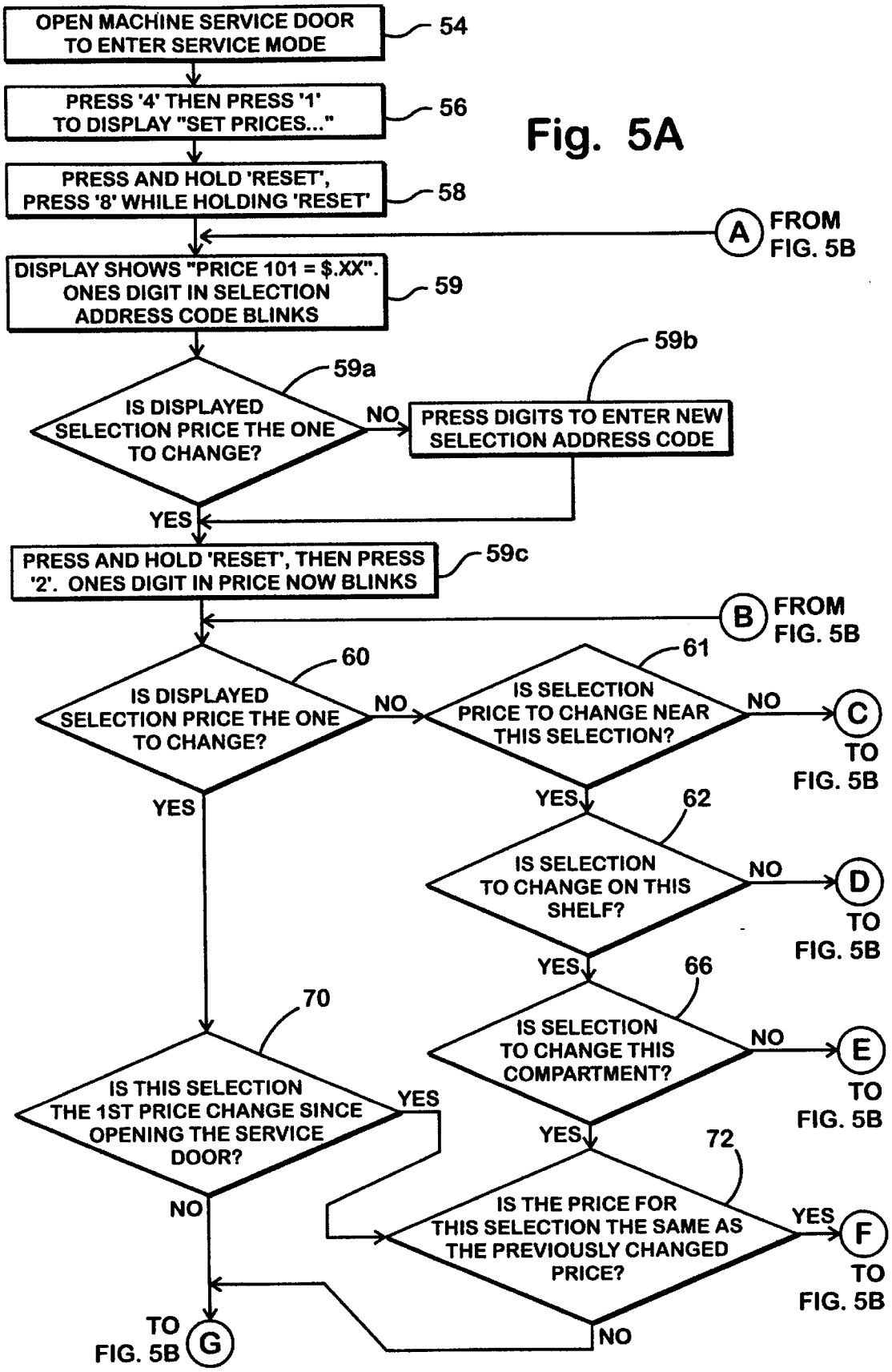
FIG. 5 is a schematic block diagram of programmable control circuitry and method of price setting according to one embodiment of the present invention.
Figure 5B:
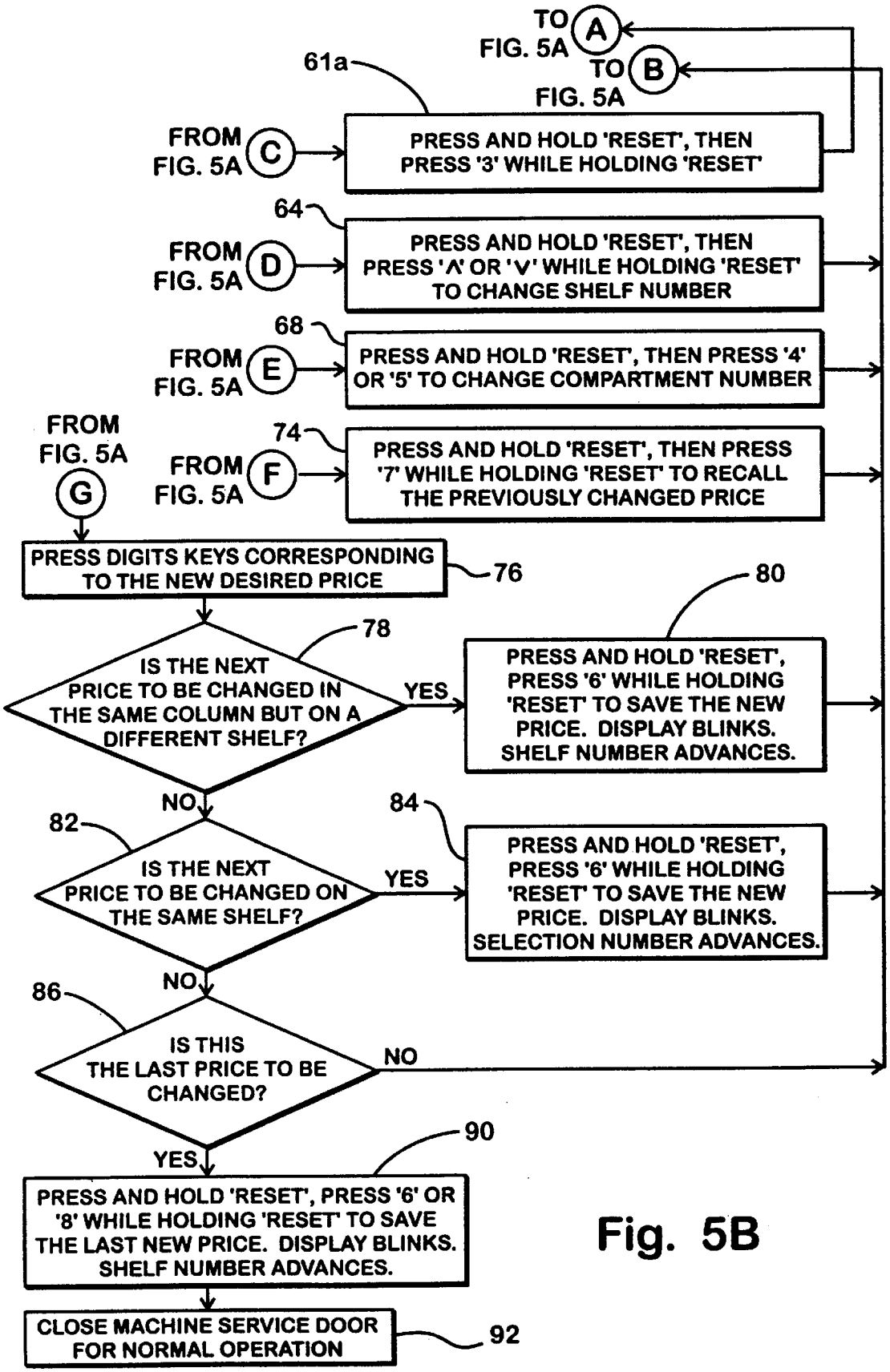

FIG. 5 depicts a schematic logic block diagram or flow chart for the price programming circuitry and its method of use for selectably programming appropriate prices for the product holding areas or compartments as they have been configured, as described with respect to FIG. 4 above. First, the vending machine is placed in the service mode by opening the service door 34, as indicated at block 54. Once in the service mode, pressing the menu item 41 displays the set prices display, as indicated at block 56. In each case where a display is generated by the control circuitry or keypad actuation, the display will appear in electronic display 26 which is desirably pivoted about pivot axis 27 with the keypad 25 after service door 34 is opened by pivoting it about hinge 34*a*, as described above. The display 26 and the keypad 24 are conveniently located so that with the door 34 opened the operator can both place products in the compartments or product holding areas and at the same time set prices for the products in the various holding areas.

Once the "set prices" mode is displayed, the operator is moved to logic block 58 to press and hold the "reset" button while pressing the number "8" button, which combination is effective as an "enter" button. The set prices mode which had been selected in block 56 is thereby entered. Once the set prices mode is entered, the display 26 will show an indication that the price of a particular shelf and a particular compartment equals a particular amount, as indicated at the display 26 depicted in block 59. The ones digit in the selection address code will blink indicating that the selection address code may be changed. Then the operator will be prompted to answer the question: Is the displayed selection price the one to change? If so, then the operator will be asked at logic block 59*c* to hold the "reset" button and press the number "2". If not, then the operator will be asked at logic block 59*b* to enter, using the digit buttons, the selection address code of the price to be changed. Then the operator will be asked at logic block 59*c* to hold the "reset" button and press the number "2". Then the operator will again be prompted to answer the question: Is the displayed selection the price to change? If not, then the operator will be asked if the selection price to change is near this selection price at question 61. If not, then the operator is moved to logic block 61*a* to hold the "reset" button and push the number "3" to allow the operator to select another selection number using the previously described method in blocks 59 through 59*c*. If the selection is near, then the operator will be asked if the selection to change is on this shelf at question 62, and if not, then the operator will be asked at logic block 64 to press and hold the "reset" button and press the number "2" or the number "3" button. The shelf number will either be increased in value (reset+2) or decreased in value (reset+3), thereby changing the shelf number. Once the shelf number is changed, logic path 65 brings the user back to the inquiry block 60. If the selection is wrong but the shelf is right, then at inquiry 62 the user will be prompted to indicate whether the selection to change is in the indicated compartment. If not, then pressing and holding the "reset" button and also pressing either the digit 4 or 5 will change the compartment number and logic path 65 will return the user to the inquiry 60. If the displayed selection is the price to be changed, then the user is moved to inquiry block 70 to answer whether the selection displayed is the first price to be changed since opening the service door. If it is, then the operator moves on to change the price at block 76. By entering the new price through the keypad digits followed by "reset" and "8" to enter the new price. If the selection displayed at 70 is not the first price to change then, for convenience, the question block 72 asks whether this price is to be the same as that for the previous price. If it is, then block 74 allows the user to simply recall the same price as previously changed so that path 75 moves the user back to the programming sequence without reentering the desired price at block 76. Either way, whether the new price is entered or the same price is moved forward.

The next logic question 78 asks whether the next price to be changed is in the same column, but on a different shelf. If it is in the same column, but on a different shelf, then at logic block 80 the new price is saved and simply the shelf number is advanced by one so that the same price can be duplicated on the same column on a different shelf. If the next price to be changed is not in the same column, then the question block 82 asks whether the next price to be changed is on the same shelf. If it is on the same shelf, then block 84 allows the user to enter the new price and advance the selection number and return, via logic return path 65, to the programming sequence for the new selection number. If the next price to be changed is neither in the same column nor on the same shelf, then the question block 86 asks whether this is the last price to be changed. If not, then the price is entered at block 88 and the user is returned to the initial programming inquiry block 60 for determining which selection is the next price to be changed and changing that price. If the last price to be changed is reached, then the user is moved to block 90 where the last price is saved by pressing and holding the "reset" key while pressing "6" or "8". This saves the new price and the user is prompted to close the service door to begin normal operation.

Figure 6:
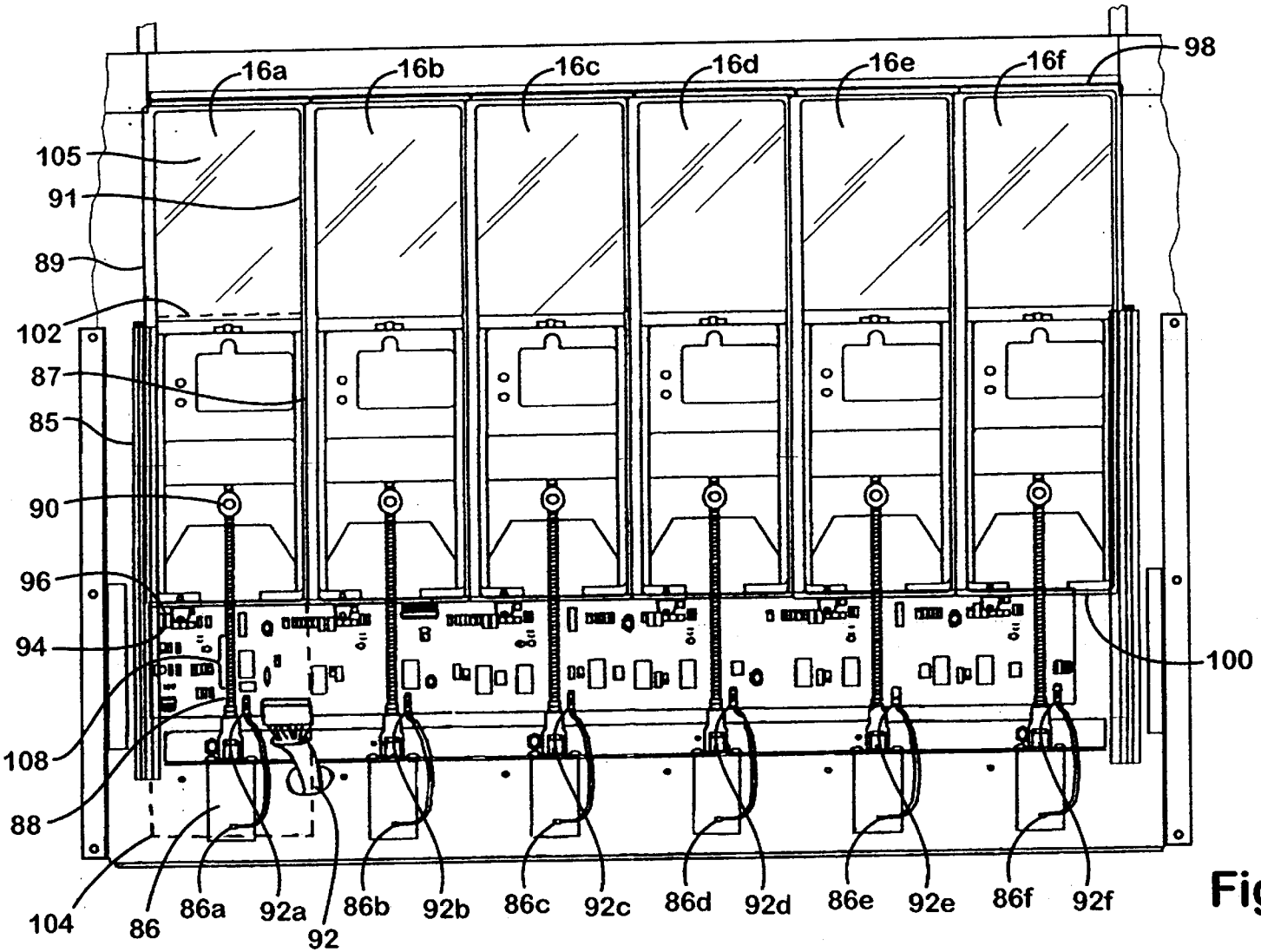
FIG. 6 is a back view of a plurality of slidable access doors each separately actuatable from a closed position to an open access position.
Figure 7:
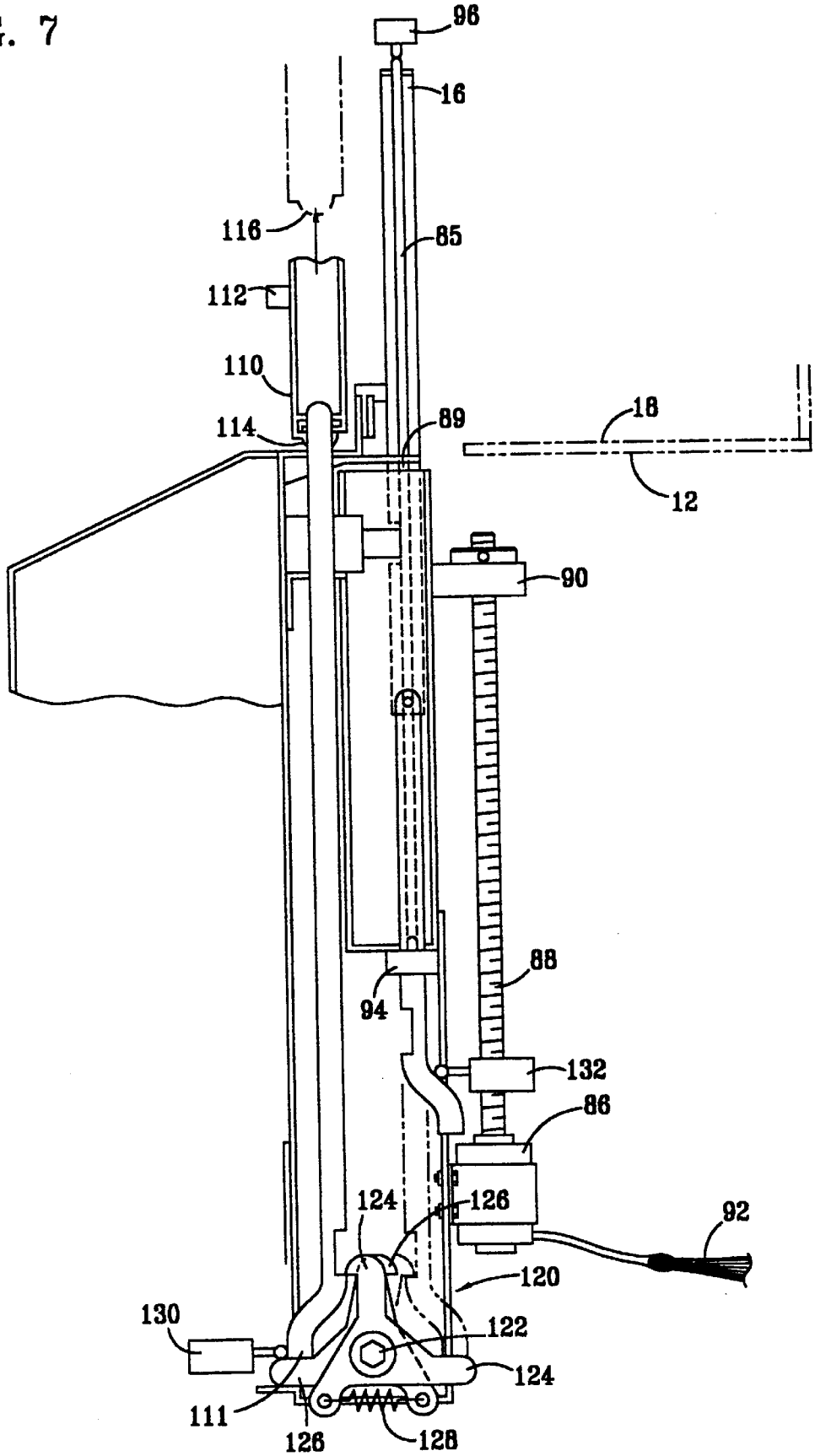
FIG. 7 is a schematic cross-sectional view taken along line 7—7 of FIG. 1 depicting a reversible electric motor for activating one of the access doors between opened and closed positions, and also depicting slidable consumer operated vending door mechanism with security and safety features for appropriately holding the door closed to prevent theft and holding the door open until the product is removed, according to one aspect of the present invention.

The details of the mechanical operation of the doors 16*a*–16*f* may be seen with reference to FIG. 6, which is a partial back view of the mechanism for opening doors 16*a*–16*f*, and also with reference to FIG. 7, which is a detailed partial cross-sectional view taken along section line 7—7 of FIG. 1 of the mechanism for opening doors 16*a*–16*f*. Each of doors 16*a*–16*f* is preferably composed of a durable, clear plastic material which acts as a window through which the product holding shelf can be viewed. Each door 16 is mounted within vertical slides 85 and 87 on either side of the doors 16 and each door 16 has, along its opposite sides, slides 89 and 91 correspondingly engaged with slide framework 85 and 87, respectively. Motors 86 and therefore a plurality of motors 86*a*–86*f* are provided individually connected to each door 16*a*–16*f*. Each motor 86 is provided with a threaded shaft 88 which is threadably engaged with a nut 90 which is fastened to each door 16. The motors are selectably actuatable from the control circuitry as through a wiring harness 92 in correspondingly separate wire connections 92*a*–92*f* to each of the individual motors. The doors 16 are moved from a closed position, as depicted in solid lines. For example, with respect to door 16*a*, in a closed position the top of the doors at line 98 and the bottom of the doors at line 100. In an open position with motor 86*a* having been rotated a predetermined number of revolutions so that a predetermined number of threads 108 rotate through nut 90. The door 16*a* moves so that its top is at dashed line 102 and its bottom is at dashed line 104. Thus, an opening area at 105 is provided for access into the vending area. In the preferred embodiment, the side sliding channels 89 and 91 extend only to the bottom of the desired dispensing position which corresponds to the top of the open door 102. Thus, if more than one door 16*a* and 16*b* are opened, the opening area extends horizontally across both doors without slide channel obstructions therebetween, although the control circuitry opens the door fully and closes it fully by reversibly turning motor 86 a predetermined number of revolutions corresponding to a predetermined number of threads 108. Alternatively, or in addition as a safety feature, an open door switch 94 and a closed door switch 96 may be used to signal the CPU 17 to deactivate the motor when the door is fully opened or fully closed, respectively.

With reference to FIG. 7, it will be seen that adjacent to access door 16 is a manually operated sliding door 110. Sliding door 110 is manually liftable as with handle 112 from its closed position 114 to an upward lifted open position 116. When door 110 is in the upward position 116, the consumer may reach through openings left by retraction of access doors 16*a*–16*f*.

As a security and safety mechanism for the vending machine, switches 130 and 132 are provided for contact by the consumer operated sliding door 110. Switch 130 operates to electrically deactivate the door opening motors 86 and also electrically signals the control circuit to deactivate movement conveyor 11 when slide door 110 is moved away from its completely down or completely closed position 114. Switch 132 similarly electrically deactivates the conveyor 11, by which the horizontal shelves 12 are moved to a vending position, whenever a door 16 is moved to an opened position. Both switches 130 and 132 reactivate the shelf conveyor mechanism 11 and the door is actuation motors 86 when the slide door 110 is in its completely closed position 114. In this manner, the consumer operated slide door 110 and motors 86 for actuating the individual access door 16 are provided with an electrical safety system which requires the slide door 110 to be in its totally closed position before the motors 86 will close access door 16. The electrical safety features act to either prevent access into open areas whenever any of the doors or shelves are moving and prevent the doors or shelves from moving whenever access into the vending machine product holding areas is permitted.

FIG. 8 depicts an overview service mode map which branches for combination with selectable menus or submenus for purposes of versatile programming and information gathering from the vending machine. Each of the submenus is separately depicted in FIGS. 9 through 14.

For purposes of providing an overview of the operation of the vending machine and its unique dual interface service mode, it is noted that the service mode is effectively the programming interface that allows the operator to gain access to the programmable features of the vending machine. It is the starting point for all programming functions. The service mode is divided into 18 menus or submenus, as shown in the service mode map of FIG. 8, which branches to logically grouped functions, options and features in FIGS. 9 through 14. To automatically enter the service mode, one opens the main service door 34.

On the service mode map, menus are listed within a menu box 140 (e.g., FIG. 8 menu box) where a menu heading 142 is listed. In total, 18 separate menu boxes or submenu boxes are listed as numbers 150, 151, 152, 153, 154, 155, 156, 157, 158, 159, 160, 161, 162, 163, 164, 165, 166 and 167 in FIGS. 9–14. Each menu box has in it a menu heading. Also, each menu box is provided with a menu number at the upper lefthand corner (e.g., menu box 150 is provided with a menu number 1 at 167). Following the menu heading 142 are submenu names 144, each of which is printed adjacent to line numbers 146. Thus, the heading of the menu is listed at the top of the menu box and, preferably, is set out in some fashion to distinguish it from the menu items. The menu items listed below the heading are the programmable options and/or submenus of that menu. Submenus are indicated by an arrow to the right of the submenu name. Direct access codes are determined from the line number listing to the left of the menu box. Preferably on the display panel 26, the menu headings are provided just as they appear on the map. Items listed after a menu heading are the programmable options and the submenus in that menu. Submenus are preferably indicated on the display 26 with an arrow to the right of the entry to signal that selection or entry of that submenu name will provide additional submenu features.

To navigate through the menu structure and to select programming options, one uses the is keypad of FIG. 2. The table of FIG. 3 outlines some of the useful functions of each digit key combined with the "reset" key. Particularly, the "reset" button plus the "zero" key equals a "line up" function, which means this combination of keys moves up one line within a menu. The "reset" plus the "1" digit equals a "line down" function, which acts to move down one line within a menu. Actuation of "reset" and the "2" key equals a "move right" function, which moves a cursor in a text string one position to the right, such as a point-of-sale message. The "reset" plus the "3" digit equals a "move left" function, which moves a cursor in a text string one position to the left, such as in a point-of-sale message. The "reset" plus the "4" button equals a "delete" function, which deletes characters within a text string, such as a point-of-sale message or a password. The "reset" plus the "5" digit equals an "insert" function, which acts to insert characters within a text string, such as a point-of-sale message or a password. The "reset" plus the "6" digit equals a "copy" function, which is used to copy a vending schedule from one day to another. The "reset" button plus the "7" digit equals a "toggle" function, which is used to toggle "on" or "off". The "reset" plus the "8" key equals an "enter" function and is used to execute a displayed function. This button combination is also used to "enter" a submenu from a menu group. The "reset" key plus the "9" digit key equals a "previous" function and is used to move backwards from one menu to the previous menu. Pressing this button combination (i.e., reset+9) one time will move the operator visual display to the top of the current menu. Pressing this combination a second time will move the operator to the top of the previous menu.

To directly access features, the numeric keypad is used to enter selection codes. Referring to the service mode map in combination with all the menus and submenus, one can determine a specific selections code. The number listed to the left of the menu heading is the menu code. The number listed to the left of the entries is called the line number and is used to access specific options. To access a specific option, one enters the menu code followed by the line number. For example, to select the $5.00 bills on/off selection, line 3 in the bill acceptor menu (menu 30), one enters "3", "0", "3" (i.e., 303). Referring to FIG. 8 and FIG. 11, the menu code in which the $5.00 bill on/off selection is found has a menu code 30. The $5.00 bills on line number is 3. Thus, the combination of the menu code 30 plus the line number 3 gives "3", "0", "3", which is the direct access selection code.

Figure 9:
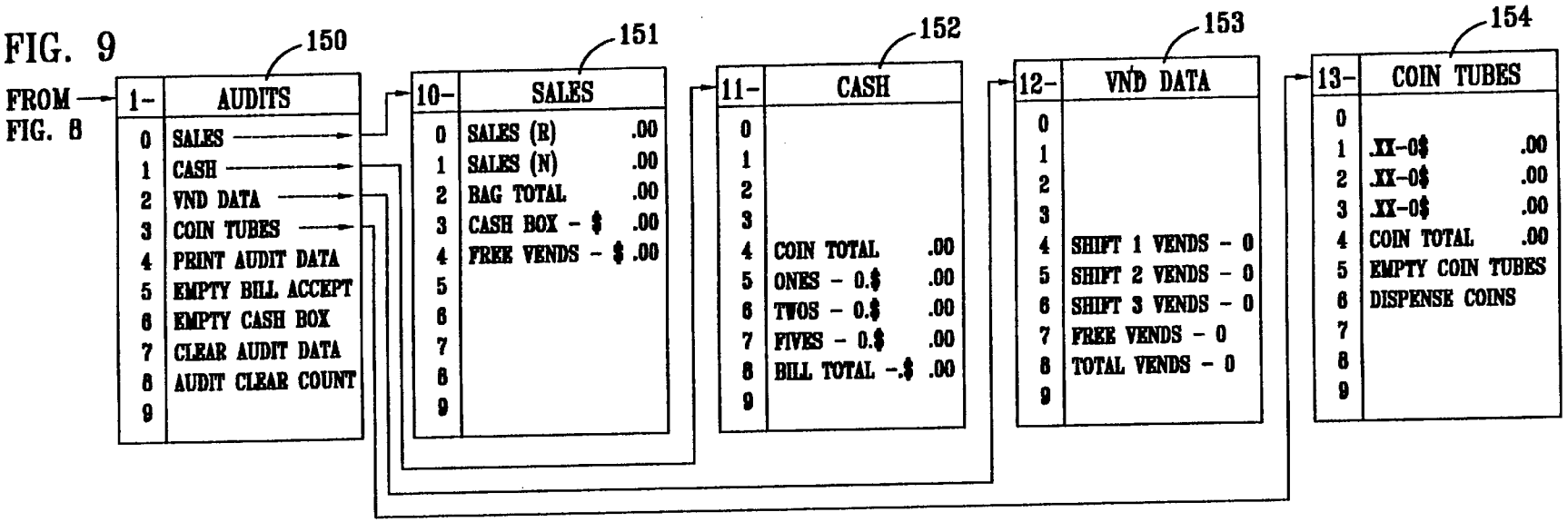
FIG. 9 is a schematic depiction of a selected portion of the service mode menu map of FIG. 8 for audits options including a submenu of subfeatures.

FIG. 9 depicts the audits options menu 150 with submenus 151, 152, 153, and 154 by which the vending machine operator or concessionaire may access sales data 151, cash data 152, vending data 153 and coin tubes data 154.

Figure 10:
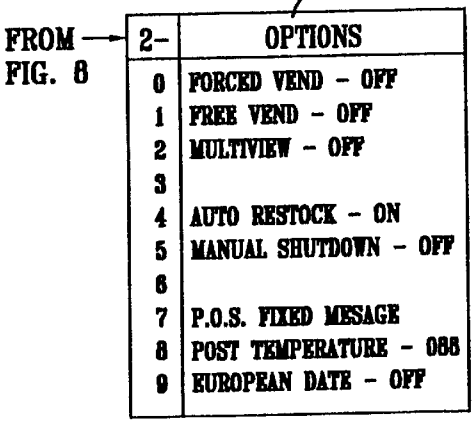
FIG. 10 is a schematic depiction of another selected portion of the service mode menu map of FIG. 8 depicting various selectable options.

FIG. 10 depicts an options menu 155 by which preprogrammed vending options, displaying options and vending machine operating options may be selected by the operator.

FIG. 11 depicts the details of the setup menu 156 which stems from the service mode menu 140. One of the features of the setup menu as described in greater detail above is the shelf configuration subfeature. From this setup menu 155, it will be observed that by selection of feature 3 of the service menu, the "setup" menu 156 is accessed and subfeature 4 "configure shelves" at 170 of the menu number 3, by depressing buttons "3" and "4" (i.e., 34), the operator may access directly to the setup shelf configuration subfeature. Alternatively through the use of the "reset" buttons and the toggle features, an operator may step-wise toggle through the service menu features until reaching the setup menu, enter the setup menu, and then toggle through the setup subfeatures and may then enter any of the subfeatures. For example, the bill acceptor subfeature may be entered and then the operator may toggle through the additional subfeatures there. Alternatively, for example, if the operator knew that the bill acceptor feature $2.00 bills was desired, this feature could be reached more directly by entering the service mode by opening door 34 and then actuating buttons "3", "0" and "2" (i.e., 302), and then "reset" and "8" at the same time (for "enter") to directly access the $2.00 bill acceptor feature in the bill acceptor mode.

FIG. 12 depicts the prices menu 160, which was discussed with respect to FIG. 5 above, for purposes of setting the prices. A "flex vend" submenu 161 is also depicted. Again, it is observed that direct access to the set prices menu may be achieved by entering keys "4" and "1" (i.e., 41). Alternatively, one could toggle through the service menu and enter "set prices" at 180 when the "prices" menu 4 is displayed; and upon entering the prices menu, toggle through until the set prices subfeature is displayed; enter the set prices mode; and then proceed, as indicated in FIG. 5, for setting the prices.

FIG. 13 depicts a status menu 162 and the subfeatures accessible in that menu.

FIG. 14 depicts diagnostics menu 163 and additional submenus for the machine history 164, baffles/shelves 165 and refrigeration 166.

Thus, with the menu driven interfaces depicted in FIGS. 8 through 14, a program is provided that combines similar options into groups called menus. To access specific options, the user moves from one menu to another or to submenus and from one option to another within a menu or submenu. This type of interface is easy to use because it is intuitive, meaning that the operator can manipulate the software of the CPU 17 with little more than common sense and a basic understanding of what the operator wants to accomplish. The menus and options selected prompt the user to move through each menu and option to accomplish what the user wants.

Direct access interface is also provided so that the operator can access specific programming features by entering a numeric code using the numerical keypad depicted in FIG. 2. This type of interface can be more efficient than the menu driven interface, because it eliminates the need to go through the layers of menus, submenus and options to reach the end goal.

Therefore, combining the menu driven interface and the direct access interface enables the user to get the most efficient use from the inventive vending machine. The interface allows an operator to interact with the electronics to set programmable options and to retrieve information from the controller or the CPU. The dual interfaces, both menu driven and direct access, allow the ease of programming inherent with a menu driven system while increasing efficiency by allowing direct access to all the programming and information management options.

Other alterations and modifications of the invention will likewise become apparent to those of ordinary skill in the art upon reading the present disclosure, the drawings and the claims, and it is intended that the scope of the invention disclosed herein be limited only by the broadest interpretation of the appended claims to which the inventors are legally entitled.

What is claimed is:

1. A vending machine having multiple size setting and multiple price setting capabilities comprising:

(a) a cabinet having a viewable area and a dispensing area;

(b) a first number of horizontal shelves vertically movable through said viewable area and positionable in alignment with said dispensing area, each horizontal shelf having an identification code;

(c) each shelf of said plurality of shelves having a second number of partitionable product holding areas, each product holding area having a designated address code;

(d) a motorized shelf movement control mechanism having a shelf position detector for determining when a given one of said horizontal shelves is positioned adjacent said dispensing area;

(e) a keypad having multiple keys interconnected with said shelf control mechanism and activatable to input a selected one of said designated address codes;

(f) a plurality of access doors in said dispensing area of said cabinet corresponding in number to said number of partitionable product holdings areas;

(g) a door opening mechanism connected to said plurality of access doors and coupled to said shelf control mechanism and said keypad for selectably opening one or more of said doors, in response to input of designated address codes at said keypad;

(h) a programmable control circuit connected to said keypad for selectably programming the price of an item to be dispensed from said product holding area having a given address code, said control circuit connected to said shelf position detection device, to said door opening mechanism, to a money receiving and counting mechanism, and for providing a signal to said door opening mechanism of a given dispensing area upon input of said address code of a given product holding area positioned at said dispensing area and upon receipt of an amount of money corresponding to said price programmed for said address code;

(i) said programmable control circuit also operatively connected for automatically causing said motorized shelf movement mechanism to move a horizontal shelf with said selected one of said designated address codes into alignment with said dispensing area;

(j) a first hinged control panel door to which said keypad is mounted and which control panel door is hingably mounted to said cabinet adjacent to said viewable area and to said dispensing area having a first closed position in which the vending machine is in a dispensing mode and having a pivotably opened position in which said vending machine is in an operator programming mode; and (k) wherein said keypad having multiple keys interconnected with said shelf control mechanism is pivotably mounted on an interior side of said pivotable control panel door said keypad having a first pivoted position substantially parallel to said control panel door in which said multiple keys are accessible through said control panel door in its closed position, and said keypad having a second pivoted position away from said control panel door when said control panel door is in its opened position so that an operator can conveniently access said keypad for programming while said control panel door is in its opened position.

2. A vending machine having multiple size setting and multiple price setting capabilities as in claim 1 further comprising:

(a) an electronic display panel mounted for pivoting with said keypad; and (b) said control panel door having an opening therethrough located adjacent to said display panel through which said display panel is viewable when said keypad is pivoted parallel to said door and said control panel door is pivoted to its closed vending position.

3. A vending machine having multiple size setting and multiple price setting capabilities as in claim 1 wherein:

(a) opening said control panel door automatically signals said programmable control circuitry to enter a service mode;

(b) said programmable control circuitry further comprises a dual first menu driven interface mode having preprogrammed options accessible by the operator by moving keypad actuation to move from one menu to the next and from one item in each menu to each next item in a menu; and (c) said keypad provides direct access interface by which the operator can access specific preprogrammed options by entering numeric codes for specific options through the numerical keypad without requiring sequential moving through each layer of menu options to reach a specific preprogrammed option.

4. A vending machine having multiple size setting and multiple price setting capabilities as in claim 1 further comprising a electronics panel positioned in said cabinet behind said closed control panel door and adjacent to said horizontal shelves, said electronics panel having a concealed position inside said cabinet behind said closed control panel door, and having a convenient access position slid outward from said cabinet along slide tray when said control panel door is in said opened position.

5. A vending machine as in claim 1 wherein said plurality of access doors in said dispensing area further comprises:

(a) a plurality of separately vertically slidable transparent doors having a first closed position and a second opened position;

(b) a plurality of electrical motors positioned spaced apart adjacent to each of said slidable access doors;

(c) a threaded shaft extending from and independently rotatable by said drive motors; and (d) a threaded connector fastened to each slide door and threadably engaged by each threaded motor shaft so that rotation of said motors causes each slide door to move from its closed position to its opened access position, and reverse rotation causes said motor to move back to its closed position.

6. A vending machine as in claim 1 wherein said numeric keypad further comprises:

(a) a plurality of numeric keys;

(b) a shelf movement control toggle key having an upward shelf movement toggle position and a downward shelf movement toggle position; and (c) a reset key which operates like a shift key on a typewriter allowing secondary functions of each of the numeric keys to be selected.

7. A vending machine comprising:

a cabinet having a viewable area and a dispensing area;

a plurality of product holding areas, each product holding area having a designated address code;

a plurality of access doors in said dispensing area, each said access door corresponding to at least one of said product holding areas;

a product holding area control mechanism and a keypad having multiple keys interconnected with said product holding area control mechanism, said keypad activated to input a selected designated address code;

a first hinged control panel door to which said keypad is mounted, said control panel door being hingably mounted to said cabinet adjacent said viewable area and said dispensing area and having a first closed position in which the vending machine is in a dispensing mode and a second pivotably opened position in which said vending machine is in an operator programming mode; and wherein said keypad is pivotably mounted on an interior side of said pivotable control panel door, said keypad having a first pivoted position substantially parallel said control panel door in which said multiple keys are accessible through said control panel door in its closed position, and said keypad having a second pivoted position away from said control panel door when said control panel door is in its opened position so that an operator can conveniently access said keypad for programming while said control panel door is in its opened position.

8. The vending machine of claim 7 further comprising:

an electronic display panel mounted for pivoting with said keypad; and said control panel door having an opening therethrough located adjacent said display panel through which said display panel is viewable when said keypad is pivoted parallel to said door and said control panel door is pivoted to its closed vending position.

9. The vending machine of claim 7 wherein opening said control panel door automatically signals said programmable control circuitry to enter a service mode.

10. The vending machine of claim 7 wherein:

said programmable control circuitry further comprises a dual first menu driven interface mode having preprogrammed options accessible by the operator by moving keypad actuation to move from one menu to the next and from one item in each menu to each next item in a menu; and said keypad provides direct access interface by which the operator can access specific preprogrammed options by entering codes for specific options through said keypad without requiring sequential moving through each layer of menu options to reach a specific preprogrammed option.

11. The vending machine of claim 7 comprising an electronics panel positioned in said cabinet behind said closed control panel door and adjacent said product holding area, said electronics panel having a concealed position inside said cabinet behind said closed control panel door, and having a convenient access position slid outward from said cabinet along a slide tray when said control panel door is in said opened position.

12. The vending machine of claim 7 wherein said at least one access door in said dispensing area further comprises:

at least one vertically slidable transparent door having a first closed position and a second opened position;

at least one electrical motor positioned adjacent to each of at least one said slidable access door;

a threaded shaft extending from and independently rotatable by said at least one drive motor; and a threaded connector fastened to each slide door and threadably engaged by each threaded motor shaft so that rotation of said motor causes said slide door to move from its closed position to its opened access position, and reverse rotation causes said motor to move back to its closed position.

13. The vending machine of claim 7 wherein said keypad further comprises a product holding area movement control toggle key having an upward movement toggle position and a downward movement toggle position.

14. The vending machine of claim 7 wherein said keypad further comprises a reset key which operates like a shift key on a typewriter allowing secondary functions of each of said multiple keys to be selected.

15. The vending machine of claim 7 further comprising:

a door opening mechanism connected to said at least one access door and coupled to said keypad for selectably opening one or more of said doors, in response to input of designated address codes at said keypad; and a programmable control circuit connected to said keypad for selectably programming the price of an item to be dispensed from said product holding area, said control circuit connected to said door opening mechanism, and to a money receiving and counting mechanism, whereby said control circuit providing a signal to said door opening mechanism of a given dispensing area upon input of said address code of a given product holding area positioned at said dispensing area and upon receipt of an amount of money corresponding to said price programmed for said address code.

* * * * *